United States Patent [19]

Anderson

[11] Patent Number: 4,981,167

[45] Date of Patent: Jan. 1, 1991

[54] METHOD OF FORMING PRODUCTS BY LOW TURBULENCE, UNIFORM CROSS SECTION INVESTMENT CASTING

[76] Inventor: Steve Anderson, c/o Stone Quality Tools, 6666 Reseda Blvd. #204, Reseda, Calif. 91335

[21] Appl. No.: 443,580

[22] Filed: Nov. 30, 1989

[51] Int. Cl.[5] ..... B22C 7/02

[52] U.S. Cl. ..... 164/35; 164/129; 164/350

[58] Field of Search ..... 164/129, 136, 35, 350, 164/34, 36

[56] References Cited

U.S. PATENT DOCUMENTS

| | | | |
|---|---|---|---|
| 3,041,689 | 7/1962 | Peras | 164/35 |
| 3,863,704 | 2/1975 | Kahn | 164/136 |
| 4,109,699 | 8/1978 | Miller | 164/35 |
| 4,246,954 | 1/1981 | Cohen | 164/129 |
| 4,467,677 | 8/1984 | Grifford | 81/16 |

FOREIGN PATENT DOCUMENTS

| | | | |
|---|---|---|---|
| 56-119641 | 9/1981 | Japan | 164/35 |
| 59-156566 | 9/1984 | Japan | 164/35 |

*Primary Examiner*—Richard K. Seidel
*Assistant Examiner*—Rex E. Pelto
*Attorney, Agent, or Firm*—Kelly, Bauersfield & Lowry

[57] ABSTRACT

The conventional investment casting technique is modified to cast metal products where the product has one or more support portons and at least one feeding tube for feeding molten metal into the cast of the product comprising providing a source of molten metal, connecting at least one metal feed tube to the mold of the metal product to be cast, of forming a hole in each support portion wherein the hole in each support portion is much larger than the volume of metal that can be non turbulently transmitted in a deflected manner into the mold by the feed tube so that the metal poured nto the generally uniform cross section mold cools gradually so that the support portions of the cast metal products will have a generally homogenous composition without air bubbles or cracks which could weaken the product.

4 Claims, 3 Drawing Sheets

METHOD OF FORMING PRODUCTS BY LOW TURBULENCE, UNIFORM CROSS SECTION INVESTMENT CASTING

This invention relates to a method of forming products by a modification of an investment casting technique, and more particularly to a method of forming multiple chuck tools by using the investment casting process.

PRIOR ART AND BRIEF SUMMARY OF INVENTION

Investment casting has been know for a long time. However prior techniques using investment casting methods were not very efficient because the molten metal was not fed into the mold through a small diameter opening, as shown in FIGS. 5 and 6. Prior investment casting processes required the molten metal to be poured through a much larger diameter feeding gate. This type of feeding would require the part to be cast to be parallel to the tree and this was inefficient because it greatly minimized the yield of the tree.

It was not realized that products could be made by investment casting techniques, by feeding the molten metal from the tree into a mold of the product through a much smaller gate in comparison to those previously used in situations where the gate is connected to the hollow mold tree and to the mold of the stem of the product so that when molten metal was poured into the hollow tree, the molten metal would fill the mold. The reason that it was not realized that the mold could be fed through a much smaller gate which was parallel to the planar support surfaces of the product was that if the mold had a large planar surface, the molten metal would not cool uniformly, causing bubbles and cracks to form in the casting and the mold of the casting would not fill properly.

Another use for investment casting is for the mass production of tools, such an integrally formed chuck tool which has differently sized chuck keys. Chuck keys are well known devices for attaching drill bits in electric powered hand drills. During construction work, it is common for the construction workers to use many different sizes of drills. These require different kinds of chuck keys for attachment to the various electric hand drills. Heretofore, as exemplified by the patent to Grifford, #4,467, 677, tools have been made with a plurality of chuck keys attached together to prevent the necessity of the worker carrying around a plurality of chuck keys which could easily be lost or mislaid. However, the prior Grifford chuck keys were welded into chuck shaft receiving openings. The problem with this arrangement is that the welds were not always strong enough to withstand the forces exerted on the tool when the chuck key is used to attach the drill bits in the drill chuck. If a chuck key is broken in a location remote from where a replacement can be obtained, construction costs are increased since it causes a loss of productive construction time.

The design patent to Fitch #DES 180,643 discloses a four way screw driver which is generally cross shaped and each leg terminates in a screw driver bit which is welded to a tubular screw driver bit retainer member. This tool, however suffers from the same disadvantages as the Grifford tool, in that the welds which hold the bits to the cross shaped frame can fail in a location remote from where a replacement can be obtained causing expensive delays in productive construction time.

To overcome the disadvantages inherent in the prior chucks and drills described above, as stated above, it would be desireable for various sized chuck keys to be cast in a single unit, as by the well known investment casting process. In this invention, four differently sized chuck keys are cast as an integral unit by the said investment casting process. However, the economic use of an investment casting process for comparatively large scale production of the multiple integral cast chuck keys is not easy to achieve, because consideration must be given to the design of the tool and of the pattern mold from the standpoint of the molten metal's ability to completely fill the cavities in the mold.

What is needed therefore, and comprises an important object of this invention, is to provide a procedure for using the investment casting process by filling complicated molds through comparatively small gates, which are in the plane or a plane parallel to a planar support surface where the mold has one or more generally planar parts.

Another important object of this invention is to provide an integrally formed multiple mold which can be manufactured in large quantities by the investment molding process.

Another object of this invention is to provide a tool having various sized chuck keys integrally formed by a casting process.

Still another object of this invention is to provide a method of simultaneously casting a plurality of tools each having integrally formed different sized chuck keys.

Still another object of this invention is to provide a cast tool having a plurality of different sized chuck keys integrally cast on a common support or tree and so shaped as to facilitate the flow of molten metal through a gate parallel of the mold cavities of the mold of the tool.

Yet another object of this invention is to design a mold for a cast tool having a plurality of various sized cast chuck keys wherein the molds can be stacked branch-like on a mold pattern tree in such a way that said tree can hold a large number of individual molds without interference, and the molten metal will flow easily and uniformly throughout all the molds mounted on the tree producing a large number of cast tools simultaneously at one pouring of the molten metal.

These and other objects of this invention will become more apparent when better understood in the light of the accompanying drawings and specification wherein.

Figure 5:
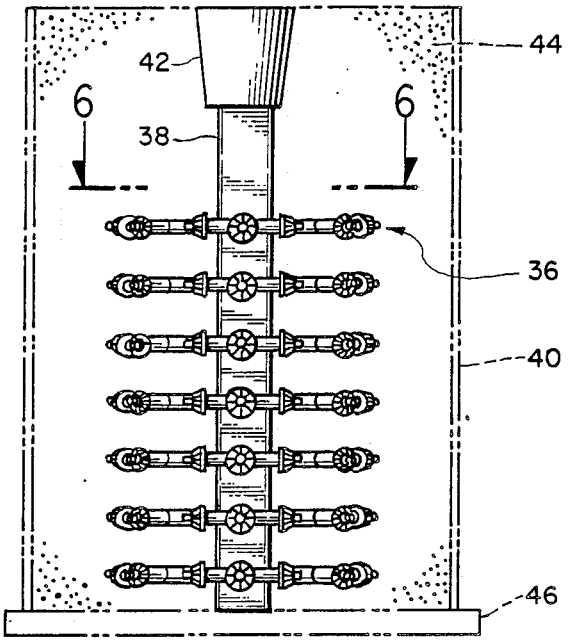

FIG. 5 discloses a tree holding a plurality of finished molds, before they are removed from the tree.

Figure 6:
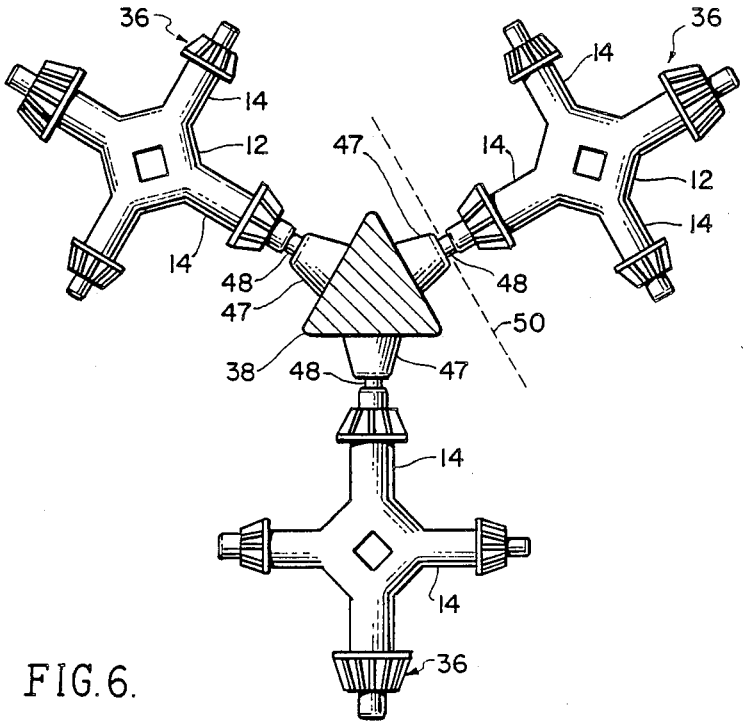

FIG. 6 discloses a plan view taken on the line 6—6 of FIG. 5 after the metal has hardened.

Figure 7:
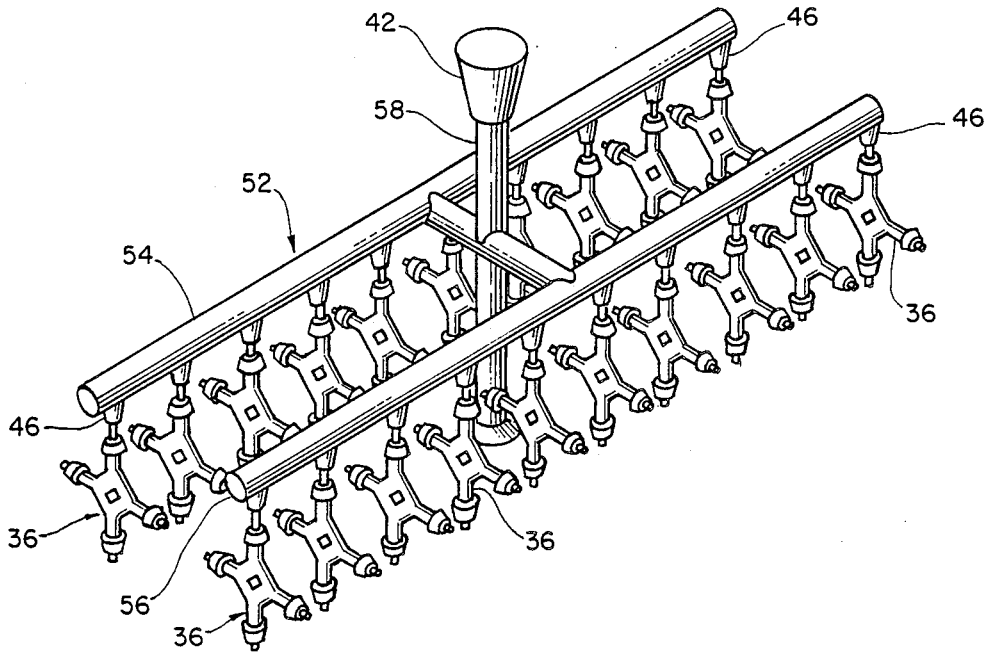

FIG. 7 discloses a modified mold tree holding a plurality of finished molds before they are removed from the tree. This embodiment would be more useful from the standpoint of production where vertical space for the tree is limited, but the horizontal space available for a tree is much larger.

Figure 1:
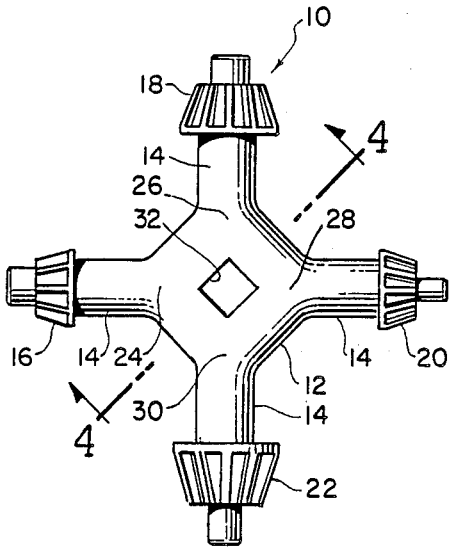
FIG. 1 is a plan view of the finished tool showing the various chuck keys extending out of the corners of the central generally rectangular support.
Figure 2:
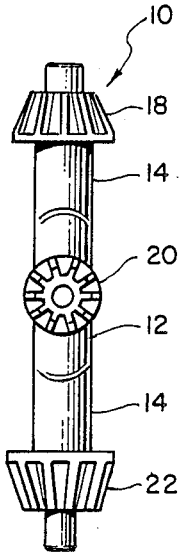
FIG. 2 is a side elevational view of the finished tool shown in FIG. 1.
Figure 3:
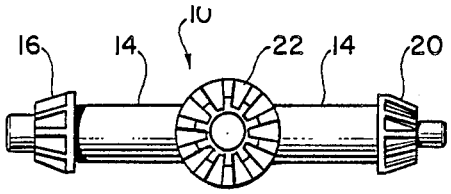
FIG. 3 is a bottom elevational view of the tool shown in FIG. 1

Referring now to FIG. 1 of the drawing, for purposes of illustration, a multiple chuck tool indicated generally by the reference numeral 10 is cast as a single unit by a modification of the well known investment casting process. The main support 12 in the embodiment shown in FIG. 1 of the tool is generally square shaped and about one inch on each side. It is to be noted that the stems 14 leading to differently sized chuck keys 16, 18, 20, and 22 extend outward from the corners 24, 26, 28, and 30 of the square shaped central support 12. Although the embodiment shown in FIG. 1 is generally square shaped it is contemplated that the support 12 could have other shapes. The main requirement being that the shape of the support have corners from which stems extend for the reasons described below, or a shape which avoids sharp turns during the molding of the product, so the molten metal can flow freely into the mold of the product.

With this arrangement, the stems 14 are foreshortened making the tool more compact. The corners 24, 26, 28, and 30 act as extensions of the stems so that the support 12 of the tool can be grasped, in such a way that the corners 24, 26, 28, or 30 extend between the fingers of the gripping hand, permitting the support 12 to be twisted easily when used. The stems 14 need not be as long as they otherwise would have to be, if the stems extended for example, from the side surfaces of the support 12.

Figure 4:
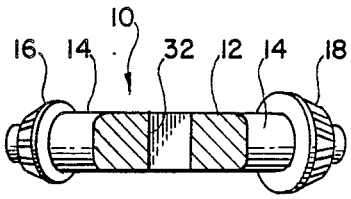
FIG. 4 is a sectional view taken on the line 4—4 of FIG. 1.

As shown in FIG. 4 a square core hole 32 is centrally disposed in the support 12. The hole 32 has the added function of permitting the molten metal forming the central support 12 to cool uniformly thereby preventing the formation of shrinkage, bubbles or cracks in the metal support 12 when the metal hardens and promotes a uniform fill of the chuck molds 16, 18, 20, and 22. As a consequence the metal forming the central support 12 will be stronger and homogeneous. In addition, if desired, the hole 12 could have various shapes, such as round, triangular, or trapezoidal, so that they could serve to operate valves and the like.

Other advantages of the design and shape of the cast tool shown in FIG. 1 can be seen in FIGS. 5 and 6. Initially, multiple wax patterns 36 of the tool are created, generally by injecting molten wax or plastic into a metal form or die of the tool. Then the wax patterns 36 are secured to a vertical centrally located wax support tree 38. The wax tool patterns 36 are, in the embodiment shown, attached by conventional means in vertically spaced relationship to each other on the central tree 38. A generally funnel shaped cup 42 at the top of the tree receives the molten metal, which flows down the tree and through the horizontal gates into the mold of the tool.

In FIG. 5, the tree 38 with the wax patterns 36 are attached as shown. In the state of the art for making investment castings, the wax patterns are placed in a bottomless and topless steel flask 40 (shown in phantom lines) on a vibrating table. Then for example, a slurry 44 of silica, (silicon dioxide), and a hardener is poured around the tree with the attached wax or plastic patterns and the flask 40 containing the wax patterns 36 is placed on a vibrating table 46 which packs the slurry against the wax patterns 36 and removes the bubbles of air. When the mold has dried and hardened, it is placed upside down in a furnace and heated to approximately 1500 degrees F. The wax or plastic patterns 36 melt and runs out, leaving the shape of the wax pattern in the form of a mold made of the hardened silica slurry. Then molten metal is poured into the funnel 42 and this metal flows through the tree into all the horizontal gates leading into the molds formed from hardened silica slurry.

As will be seen below, the configuration of the castings produced by this mold will be identical to the wax pattern tree 38 with its branches of article or tool patterns 36.

This arrangement optimizes the investment molding process for a greater production of the tools because if the tree is vertical as shown in FIG. 5 it could have many branches, each holding molds of the tool. In the embodiment shown, the tree has seven branches and each branch has three molds of the tool. As a consequence twenty one tools can be formed by one pouring of the metal. Of course if greater production is desired, the size of the tree and the number of branches could be increased.

The molten metal flows through horizontal nipples or gates 47 which are hollow tubes leading from the mold into the tree. The molten metal then flows through each of the horizontal mold stems 14 (usually the largest in diameter) into the mold cavities of the tool, thus filling each cavity of the tool molds 36. It is noted that the recessed diameters 48 at the adjoining stems and gates of each mold of the tool facilitates the removal of each tool from the tree by means of band saw cutting along lines 50.

At this point, referring to FIGS. 1 and 6, the advantage of forming the stems 14 at the corners of the central support 12 becomes more apparent because using the investment casting technique, the flow of metal into the molds is not interrupted by sharp turns in the mold pattern.

The end result is that in the embodiment shown in FIG. 5 there are seven layers of molds 36 with three molds on each layer so that a total of 21 tools are formed on this tree each time the metal is poured. It is, of course, obvious that according to need, additional numbers and layers of molds would be used.

Having described the invention, what I claim as new is:

1. A method for forming cast metal products of the type having a generally square shaped central support portion defined by generally flat horizontal faces spaced by generally flat vertical sides, and a plurality of coplanar stem portions each projecting horizontally outwardly from the central support, the method comprising the steps of:

forming an elongated hollow tree mold having an open end for receiving molten metal and a closed end;

forming a plurality of separate product molds each having a generally hollow square shaped central support portion and a plurality of coplanar hollow stem portions projecting outwardly therefrom and in flow communication therewith, the hollow square shaped support portion being formed with a solid square shaped core extending generally centrally therethrough such that the cross-sectional area of said hollow support portion is substantially uniform throughout;

coupling each of said product molds with said tree mold through an outboard end of a selected one of said hollow stem portions so that molten metal received in said tree mold can flow into said product mold through said one hollow stem portion; and flowing molten metal into the open end of the tree mold such that the molten metal flows into and fills each of the product molds by passage through the selected one of the hollow stem portions and further through the hollow central support portion to each of the remaining hollow stem portions, with the solid core of each product mold deflecting the metal in a non-turbulent flow and the substantially uniform cross-section of the hollow central support portion promoting uniform and substantially crack-free solidification of the molten metal.

2. The method of forming cast metal products as set forth in claim 1 including the step of forming a flow communication gate having a cross-sectional area less than the cross-sectional area of the selected one of the hollow stem portions between the product mold and the tree mold for coupling each of the product molds to the tree mold.

3. The method of forming cast metal products as set forth in claim 1 including the steps of orienting the elongated tree mold along a generally vertical axis, and coupling each of the product molds to project outwardly from the tree mold in generally parallel horizontal planes spaced along the tree mold prior to flowing molten metal into the tree mold.

4. The method of forming cast metal products as set forth in claim 3 further including the step of coupling a plurality of product molds to the tree mold in each of the spaced generally horizontal planes.

* * * * *